United States Patent [19]

Vögel

[11] Patent Number: 4,753,225

[45] Date of Patent: Jun. 28, 1988

[54] THERAPY EQUIPMENT FOR THE HUMAN BODY

[76] Inventor: Pius Vögel, Weissach 35, Oberstaufen, Fed. Rep. of Germany, 8974

[21] Appl. No.: 931,595

[22] Filed: Nov. 17, 1986

[30] Foreign Application Priority Data

Nov. 22, 1985 [DE] Fed. Rep. of Germany ..... 3541350

[51] Int. Cl.[4] ..... A61H 23/00; A61H 21/00

[52] U.S. Cl. ..... 128/33; 128/32

[58] Field of Search ..... 128/33, 32, 24

[56] References Cited

U.S. PATENT DOCUMENTS

| | | | |
|---|---|---|---|
| 1,970,233 | 8/1934 | Hertzberg | 128/33 |
| 3,601,121 | 8/1971 | Roberts | 128/33 |
| 3,880,152 | 4/1975 | Nohmura | 128/33 |
| 4,023,556 | 5/1977 | Martinmaas | 128/33 |
| 4,055,170 | 10/1977 | Nohmura | 128/33 |
| 4,132,228 | 1/1979 | Green | 128/33 |
| 4,544,867 | 1/1985 | Jones, Jr. et al. | 128/33 |
| 4,635,287 | 1/1987 | Hirano | 128/33 |

FOREIGN PATENT DOCUMENTS

| | | | |
|---|---|---|---|
| 1090227 | 11/1980 | Canada | 128/33 |
| 2745002 | 7/1978 | Fed. Rep. of Germany | 128/33 |
| 3430882 | 3/1986 | Fed. Rep. of Germany | 128/33 |

*Primary Examiner*—Edgar S. Burr
*Assistant Examiner*—Tonya Lamb
*Attorney, Agent, or Firm*—Thomas S. MacDonald; Alan H. MacPherson; Paul J. Winters

[57] ABSTRACT

The therapy equipment for the human body serves to enhance the feeling of good health by exposure of a part of all of the body, to accoustic irradiation with frequencies in the sub-audio, audio and ultrasonic regions. The therapy equipment consists of at least one oscillator plate which is arranged in bodily contact with the body of the person who sits, lies or stands on it, in which the oscillator plate is made to oscillate by sound waves, whereby corresponding oscillation generators are secured in bodily contact to the oscillator plate. The frequency of the sound waves is adjusted to the reabsorption frequency of individually selected organs and parts of the body, to treat selective individual organs or parts of the human body.

8 Claims, 3 Drawing Sheets

THERAPY EQUIPMENT FOR THE HUMAN BODY

BACKGROUND OF THE INVENTION

The present invention concerns therapy equipment for the human body with which it is possible to treat dissimilar organs of the body accurately by oscillations, in which these oscillations, are introduced into a particular organ through bodily conduction without the propagation of sound in air. The aim is the enhancement of the feeling of good health.

Previously it was the custom to form such therapy equipment as hand equipment in which a sound head was positioned on a hand grip and the sound head was supplied with signal current from a signal generator, the sound head was then directly positioned by hand on specific parts of the body and the part of the body was then accurately treated by this equipment. The sound head was preferably supplied with a sub-audio frequency so that good conduction ensued between the sound head and the body to be treated.

A disadvantage of this known therapy equipment is that only a single frequency was used and this frequency did not match the body organ to be treated. Treating with only a single frequency, usually in the sub-audio region, did not always ensure success of the therapy.

A further disadvantage of this known equipment is that just one single organ, usually an external part of the body such as a shoulder blade, a thigh or the knee joint could be treated and that internal organs of the body were not accessible for treatment.

BRIEF SUMMARY OF THE INVENTION

The present invention is based on the technical problem of the further development of therapy equipment of the type mentioned in the introduction so that a complete treatment of the body, including the inner organs, is possible.

To solve the problem posed, the invention is characterized in that the therapy equipment consists of an oscillator plate on which the human body is arranged, in which the person either sits, lies or stands, and that the oscillator plate is made to oscillate by sound waves in which the sound waves are introduced into the oscillator plate by a number of loud speakers, in which the loud speaker is secured in contact with the underside of the oscillator plate and shielded against the propagation of sound waves into the immediate surroundings.

A completely new kind of therapy is provided by the therapy equipment of this invention. In a preferred embodiment of the present invention, the oscillator plate is formed in connection with the underpart of a bench on which the patient sits.

A particularly beneficial sound conduit into the human body arises by a direct contact between the bones of the human body in the area of the posterior and the oscillator plate.

Here a preferred embodiment example of the invention provides that the oscillator plate (2) (FIG. 2) is attached to a raised seat board and the seat board is shaped to the buttocks, so that the buttocks of the person to be treated are located directly on the seat board and the bones of the pelvis of the person engage with convex areas of the seat board and thus come into direct contact with the seat board. These convex areas are anatomically shaped so that bodily contact of the pelvis bones to the seat board and thus to the oscillator plate is always ensured.

Such a seat board is arranged on the oscillator plate to correspond to the bodily position of the posterior of the person to be treated.

If the person undergoing therapy sits on the oscillator plate in the lotus position then the seat board is arranged more to the rear of the oscillator plate, whereas in the normal vertical seating position (with the legs hanging) of a person undergoing therapy, the seat board is attached more in the middle or to the front of the oscillator plate. For this purpose several seat boards are available, namely a rear one for acoustic irradiation of the person for example in the "lotus position", and a forward seat board for a normal vertical sitting position.

Many years of research by the inventor have shown that each specific organ of the body can be coordinated with a specific sound frequency in which each organ reacts sensitively to this specific sound frequency and is thus responsive. The specific coordination of the bodily organs to the respectively coordinated sound can only be felt if this organ of the person is actually absorbing sound energy. As a rule a warm feeling is induced in this organ by the usage of this therapy equipment as well as a strong vibration of the affected organ.

It was particularly noticed that each specific organ can be coordinated to one tone in the harmonic scale.

The following list is an example:

Tone G: Intestine (complete); Tone D: Stomach; Tone D sharp: left leg; Tone F sharp: right leg; Tone A: bronchial tubes; Tone E: bladder, etc.

The given tones of the harmonic scale can be taken from different octaves, for example it was found that for the treatment of the complete intestines a frequency spectrum of the following tones was particularly beneficial in various forms of successful therapy; namely the tone G at a frequency of 49 Hertz mixed with tone G at a frequency of 196 Hertz together with an overtone B at a frequency of 123.5 Hertz.

The mixing in of overtones has been found to be particularly effective as long as these overtones are in harmonic ratio to the base tones.

Similarly therefore all other bodily organs, even internal ones, can be treated.

If one tone of the harmonic scale is coordinated with several organs and more than one organ is affected it has been found that the most-affected organ responds first to the tone and absorbs it.

A preferred sound generator, in accordance with the invention comprises an apparatus which contains a series of signal generators in which each signal generator is capable of producing a finely adjusted tone.

In the present example three signal generators are set to provide a desired frequency spectrum: the first to the frequency 49 Hertz, the second to 196 Hertz and the third to 123.5 Hertz.

All output signals of this signal generator will be mixed together at the output of the complete apparatus and transmitted to the loud speakers, which are arranged beneath the oscillator plate and in contact with it.

In this way the oscillator plate is excited by this frequency spectrum and the frequency spectrum is introduced into the body by the oscillator plate.

The present invention is not limited to the formation of the therapy equipment as an oscillator plate with a base of loudspeakers in which the loudspeakers are mounted beneath it on a stand. In a further development it is possible to arrange the loudspeakers all together in a box-shaped housing.

A further embodiment of the present invention provides that not only the seat surface is excited by such a frequency spectrum but also a back surface. In this embodiment, such therapy equipment has a back surface likewise formed as a box in which one or more loudspeakers are arranged.

It is important in the case of this embodiment that the back plate can be excited by a different frequency spectrum from that of the seat plate thus offering multiple therapy possibilities.

The invention will now be further described by means of several embodiments.

DETAILED DESCRIPTION

Figure 1:
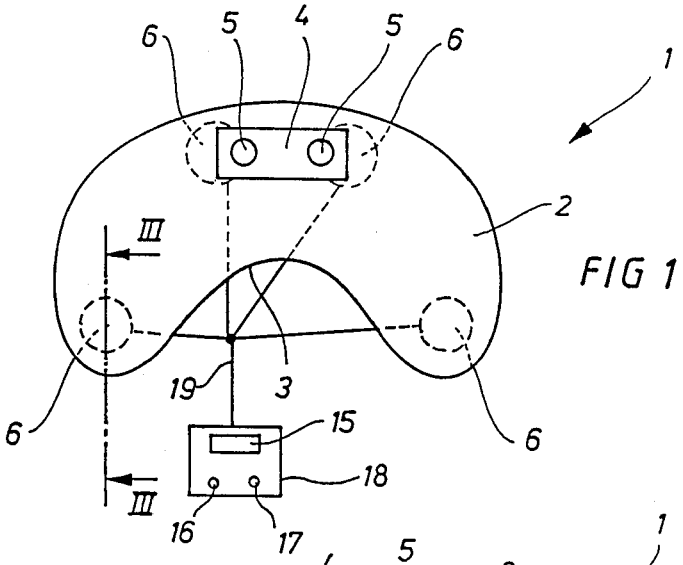
FIG. 1 is a schematic plan view of the therapy equipment including signal generator.
Figure 2:
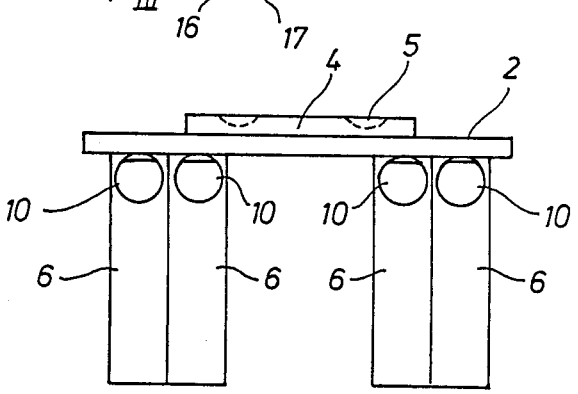
FIG. 2 is a side elevational view of the equipment.
Figure 3:
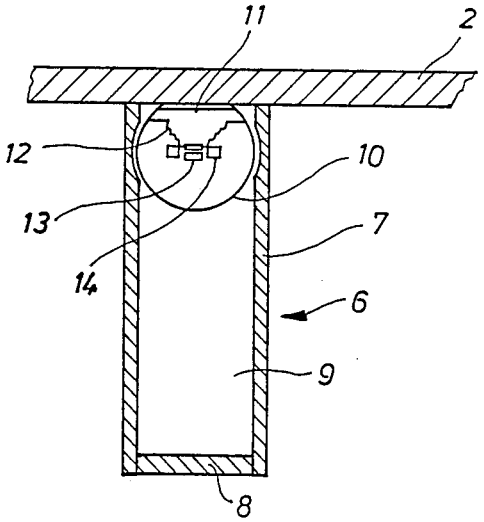
FIG. 3 is a cross-sectional view taken on the line III—III of FIG. 1.

In the embodiment in accordance with FIGS. 1 to 3, the therapy equipment (1) consists of a kidney-shaped oscillator plate (2) which has a forward-facing indentation (3). This indentation is necessary to make a comfortable seat for a person sitting in the "lotus position" (during Yoga meditation).

Further, this indentation (3) also makes possible a comfortable vertical sitting position for smaller people with shorter thighs.

The oscillator plate (2) preferably consists of a solid wood plate with protruding annual rings (growth rings) because in this way a particularly beneficial propogation of oscillation is ensured.

On the oscillator plate in the rear area, a seat board (4) is provided which has anatomically-shaped recesses (5) for the buttocks so that the buttocks of the person undergoing therapy sitting on the seat board (4) fit exactly into the buttock recesses (5) and thus the pelvic bones come into bodily contact with the seat board (4).

The seat board (4) can be of different thicknesses of between approximately 4 to 12 cm.

On the underside of the oscillator plate (2) preferably four legs (stands) are attached; however, it could be more or less than four legs.

The legs also serve as oscillator tubes (6) for the loudspeakers (10) in which each loudspeaker (10) is connected in bodily contact with the oscillator plate (2) in the upper part of each oscillator tube (6), particularly by glueing or screwing, in which the sound output opening (11) of each loudspeaker acts directly on the underside of the oscillator plate (2).

This method avoids sound propagation by air, as preferred sound propagation is achieved by bodily contact with the oscillator plate.

The oscillator tubes (6) are hollow and filled with air in which, in the oscillator tubes (6), a specific phenomenon can be generated which acts in amplified fashion on the oscillator plate (2).

In a preferred layout of the present invention in accordance with FIG. 3, each oscillator tube (6) consists of a hollow wooden cylinder (7) in which the wooden cylinder is covered and closed at the bottom by a solid base plate (8).

At the top, the wooden cylinder (7) is securely attached to the underside of the oscillator plate (2), and in the upper region of each wooden cylinder (7) a loud speaker (10) is arranged whose sound output opening (11) is directly beneath the oscillator plate (2).

In this way the described bodily contact between the loudspeaker (10) and the oscillator plate (2) is achieved, in which air space (9) arranged in the hollow cylinder (7) acts on the oscillator plate (2) in the manner of resonance amplification.

In the known way, each loudspeaker (10) consists of a diaphram (12) which is connected to an oscillator core (13) in which the oscillator core is surrounded by a winding (14).

The loudspeakers (10) (FIGS. 2 and 3) are, in accordance with FIG. 1, connected in parallel and are each on a line (19) on the output of a signal generator (18), in which this signal generator consists of, as already described, a number of individually adjustable signal generators, of which each can be set to a specific frequency, which can be read off on the frequency indicator (15), in which for each loudspeaker the frequency adjustment (17) can be made separate from the volume adjustment (16).

In this way, therefore, a specific frequency spectrum is transmitted through the line to the loudspeaker (10), in which the signal generators preferably have a high output performance in the region of 100 Watts, so that a significant oscillatory influence is possible on the person undergoing therapy. The output performance is then adjusted depending on the sensitivity of the person being treated.

Figure 4:
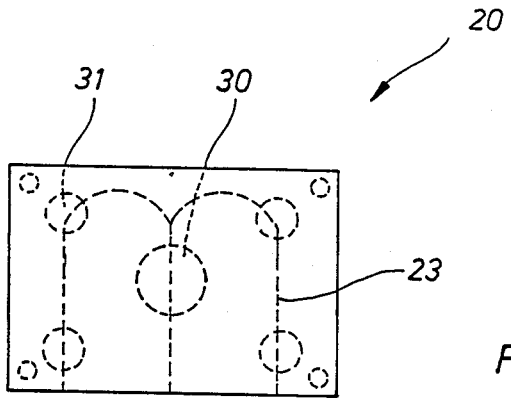
FIG. 4 is a schematic plan view of a second embodiment of the equipment.
Figure 5:
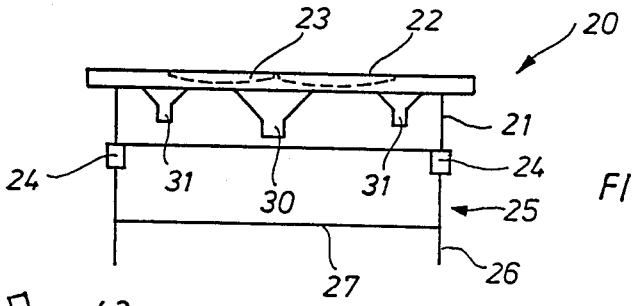
FIG. 5 is a side elevational view of the equipment shown in FIG. 4.

FIGS. 4–5 illustrate a further embodiment type of therapy equipment (20) which in this case consists of a closed box (21) in which are arranged several loudspeakers (30)(31).

In the preferred embodiment described here, a bass loudspeaker (30) is arranged in the middle of the oscillator plate (22) of the box (21) on its underside, and adjacent to the four corners of the oscillator plate (22), four treble loudspeakers (31) are arranged.

The box (21) is, of itself, completely closed, and on its underside damping elements (24) are arranged onto which a base (25) joins, which preferably consists of support legs (26) with interspaced struts (27). This base (25) is placed at normal seating height so that a comfortable sitting position on the therapy equipment is possible. The damping element (24) serves to shield the base (25) from the oscillations generated in the box (21).

The upper side of the oscillator plate (22) is again provided with buttock recesses (23) to ensure good bodily contact between the body of the person undergoing therapy and the oscillator plate (22) in the way previously described. The buttock recesses (23) also serve to ensure a comfortable sitting position so that long-term sitting is not found to be strenuous.

Figure 6:
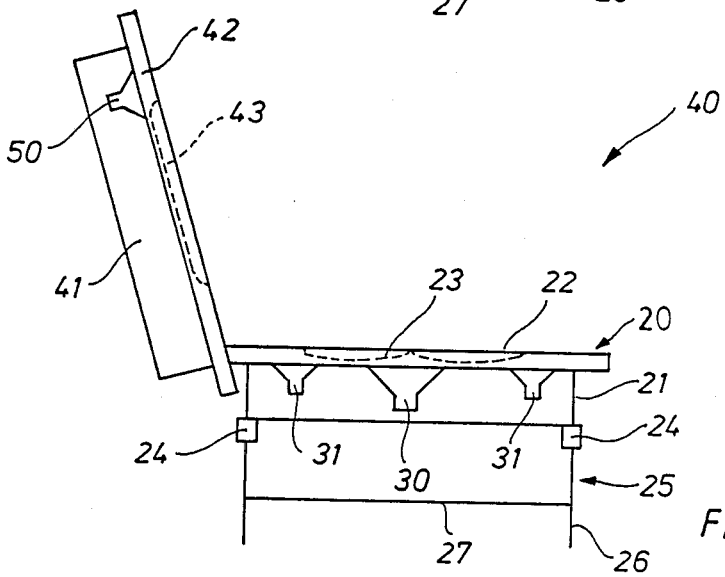
FIG. 6 is a side elevational view of a third embodiment of the equipment.

FIG. 6 illustrates a further embodiment type of therapy equipment (40) which consists of a combination of the therapy equipment (20) in FIGS. 4 and 5 with a further box (41) in which by means of the upper box (41) arranged obliquely to the lower therapy equipment (20) treatment of a person's back is made possible.

The same parts of the therapy equipment (40) have the same index numbers as the same parts of the therapy equipment (20) in accordance with FIGS. 4 and 5.

The arrangement of a box (41) with a similar oscillator plate (42) and internally-arranged loudspeakers is advantageous in that both the back and the seat area of the person can be separately but simultaneously treated during the same therapy period.

It is therefore possible, for example, to control the loudspeaker (50) in the box (41) at a different frequency spectrum in which it is a requirement that the frequency spectrum in the box (41) has a harmonic ratio with the frequency spectrum in the box (21), in order not to introduce total disharmony into the human body.

It is particularly preferable here to select for the loudspeakers (30)(31) in the lower box (21) the deeper octaves of the range of audibility, whereas in the upper box (41) the treatment of the person's back uses the higher octaves. It is likewise provided that in the upper inclined oscillator plate (42) corresponding back recess (43) are anatomically arranged to provide a comfortable leaning-back position.

The frequency range of the frequencies used here are preferably from a low D at a frequency of 8.1 Hz (subaudio) to a high B at a frequency of 62,208 Hz (ultrasonic).

A further important area of application of the present invention is that all of the therapy equipment (1)(20)(40) can also be used under water. The propagation of soundwaves under water has—due to better sound conductivity—an even greater influence on the human body.

Figure 7:
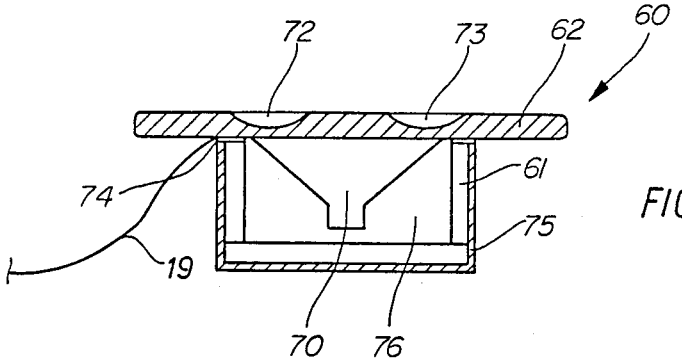
FIG. 7 is a cross-sectional view taken on the line VII—VII of FIG. 8.
Figure 8:
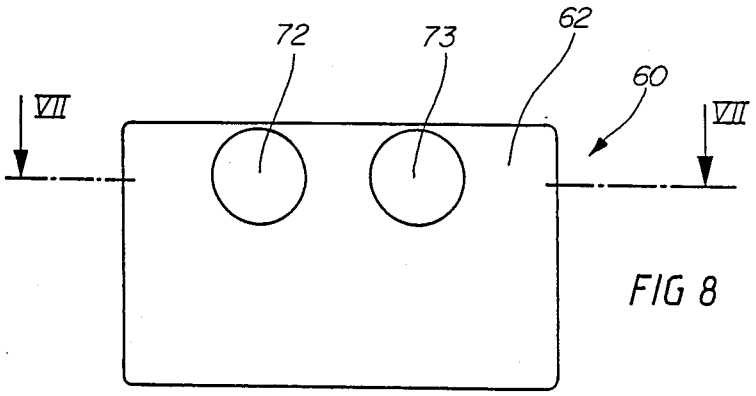
FIG. 8 is a schematic plan view of a fourth embodiment of the equipment.
Figure 9:
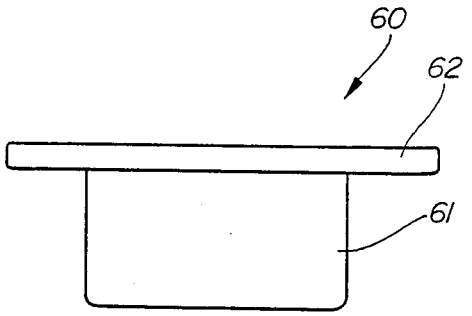
FIG. 9 is a side elevational view of the fourth embodiment.

In FIGS. 7 to 9 a further embodiment of the therapy equipment is illustrated, which is a modified type of the therapy equipment shown in FIGS. 4 and 5. An oscillator plate (62) is secured on the closed wooden box (61) extending beyond the edge of the box (61) in which, between the upper peripheral edge of the box (61) and the oscillator plate (62) a continuous seal (74) is arranged. The oscillator plate (62) is, as in the other embodiment, a solid wooden plate with raised annual (growth) rings which ensures an excellent sound conduction. On one long side of the oscillator plate (62) are arranged two recesses (72) (73), at breast spacing, in the oscillator plate (62).

These recesses serve to accept the female breasts in which the upper body of the person to be treated is bent over the recesses (72) (73) so that the breasts lie in the recesses (72) (73). For the treatment of hands and breasts the equipment can be placed on a table or second chair. For treatment of the feet (ankles to toes) the equipment is placed on the floor.

The introduction of sound waves into the human body is therefore achieved through one bearing point of the body on the oscillator plate (62) outside the recesses (72) (73), and into another through the recesses (72) (73), on the upper body of the female to be treated. With this special form of therapy, health-giving and recuperative actions, particularly in the area of the female breast, can be carried out.

In a further embodiment (not illustrated), recesses (72) (73) in pairs can be made in the oscillator plate in which each pair of recesses has a differing depth thus ensuring an optimal contact surface for breasts of differing sizes.

The box consists of glued plates (35) (cabinet-makers boards) which are covered with a soft upholstery. This forms a resonance space (76) inside the box, which the loudspeaker (70) is arranged and in and from which loudspeaker electrical line exits.

What I claim is:

1. Therapy equipment for the human body for the enhancement of the good feeling of good health by exposure of parts or all of the body to acoustic irradiation with frequencies in the subaudible, audible and ultrasonic regions, the therapy equipment comprising at least one oscillator plate arranged to be in bodily contact with the human body and which is excited to oscillation by soundwaves, characterized in that the frequency of the soundwaves is adjusted to coordinate with the individually-selected organs and parts of the body, and wherein said at least one oscillator plate (2) has a flat wooden body; said therapy equipment further comprising a multiplicity of hollow wooden cylinders (7) extending beneath and attached to said body to form legs, at least one loudspeaker (10) secured inside each of the hollow cylinders (7), said loudspeakers being in bodily contact with the oscillator plate (2).

2. Therapy equipment in accordance with claim 1, further including a seat board (4) secured on a portion of the upper side of said oscillator plate, said seat board including buttock recesses (5) on an upper surface thereof.

3. Therapy equipment for the human body for the enhancement of the good feeling of good health by exposure of parts or all of the body to acoustic irradiation with frequencies in the subaudible, audible and ultrasonic regions, the therapy equipment comprising at least one oscillator plate arranged to be in bodily contact with the human body and which is excited to oscillation by soundwaves, characterized in that the frequency of the soundwaves is adjusted to coordinate with the individually-selected organs and parts of the body, and wherein said at least one oscillator plate is essentially horizontal; said therapy equipment further comprises at least one hollow enclosed box extending beneath said oscillator plate and supporting said oscillator plate, at least one loudspeaker secured within said at least one box and having a loudspeaker sound outlet opening in bodily contact with said oscillator plate.

4. Therapy equipment in accordance with claim 3 wherein said oscillator plate is a solid wooden plate having annual rings on an upper surface for ensuring sound conduction therefrom.

5. Therapy equipment in accordance with claim 3, wherein said at least one loudspeaker comprises a multiplicity of loudspeakers, signal generators (18) each connected to one of said loudspeakers, means for setting each signal generator to a specific frequency, such that a frequency spectrum from the signal generators (18) is transmitted through a transmission line (19) to said loudspeakers (10).

6. Therapy equipment in accordance with claim 3, wherein said at least one hollow box (21) is closed on all sides forming a single box; wherein said at least one loudspeaker comprises a multiplicity of loudspeakers, said loudspeakers being oriented in said single box in a pattern being in bodily contact with the underside of said oscillator plate.

7. Therapy equipment in accordance with claim 3 further comprising a second essentially vertical inclined oscillator plate extending from said essentially horizontal oscillator plate to be in contact with a human body back, said second oscillator plate including a loudspeaker attached thereto.

8. Therapy equipment in accordance with claim 3 wherein the oscillator plate (22) includes at least two recesses (32) (33) in a top surface thereof arranged with a spacing corresponding to that of female breasts of the human body and which are sized for the acceptance of female breasts.

* * * * *